United States Patent [19]

Nichols et al.

[11] Patent Number: 4,533,179

[45] Date of Patent: Aug. 6, 1985

[54] PORTABLE SEATING ASSEMBLY

[75] Inventors: James Nichols, Old Saybrook, Conn.; Franklyn M. Markus, 5725 Cote St. Luc, Hampstead, Quebec, Canada, H3X 2E6

[73] Assignee: Franklyn M. Markus, Quebec, Canada

[21] Appl. No.: 496,682

[22] Filed: May 20, 1983

[51] Int. Cl.[3] ..... A47C 7/00

[52] U.S. Cl. ..... 297/440; 108/115; 297/DIG. 2

[58] Field of Search ..... 108/115; 297/440, 16, 297/DIG. 2; 248/166

[56] References Cited

U.S. PATENT DOCUMENTS

| | | | |
|---|---|---|---|
| 2,988,844 | 6/1961 | Frimberger | 297/443 X |
| 3,220,362 | 11/1965 | Downes | 297/440 X |
| 3,438,345 | 4/1969 | Lasaine et al. | 108/115 |
| 3,606,459 | 9/1971 | Krone | 297/440 |
| 3,727,979 | 4/1973 | Schier et al. | 297/440 |

*Primary Examiner*—Philip C. Kannan

*Attorney, Agent, or Firm*—Paul J. Sutton

[57] ABSTRACT

The present invention provides a portable assembly whose members can be unfolded to form a seat or a table. The assembly comprises five flat members, one member being the seat or table top, and the other being the supporting members. The assembly is preferably unitary with each member being rotably connected with one another at coextensive linear edges that are flexibly connected. In the assembled position, the seat or table top is set upon an upright support member that is set on a bare surface. Another support member is angled upwards to the underside of the seat member, while yet another support member meets the angled support member at the underside of the horizontal seat, or table, member. Still another support member extends approximately horizontally at surface height to brace the other three support members connecting to the upright member by a demantable connecting means. In the disassembled, folded, position, the five members fold against one another, with two pairs of members being nested.

10 Claims, 17 Drawing Figures

PORTABLE SEATING ASSEMBLY

The present intention relates generally to portable chairs and more particularly to a portable chair assembly that can be assembled into a chair and disassembled into a compact space. The concept of the present invention can also be applied to a portable table.

Tables and chairs that are collapsible and fitted together into a small space for transporting in the trunk of a car and easily stored at home are well-known. These disassemblable units are used on picnics, camping trips, at home indoors and outdoors, and with mobile homes. The usual combination is a collapsible table forming an enclosed space sufficient to contain four collapsible chairs. The usual type of chair having a pair of rotatably connected legs with seats of canvas, nylon fabric, or other similar material is well-known. Other chairs of varying design are known in the art. Such chairs are commonly uncomfortable and unsightly, particularly the fabric-seat type of chair. These chairs have the advantage of being easily stored and set into usable assembly, it is true, but they have the disadvantages described and, in addition, do not stand up well to movements by the user, that is they have a tendency to be rickety. These fabric seats are also liable to damage from cutting or burning. Finally, these seats, once they become wet, take time to dry.

It is worth mentioning also that collapsible tables known in the art have a number of different disadvantages than to chairs just discussed. The common type of portable table known in the art is one having four detachable legs that are separately placed in the storage compartment of the portable table. When the table is to be used, the legs are removed from the compartment and screwed or otherwise mounted into receiving holes at the four corners of the table. These tables are also satisfactory in many respects, but it is worth noting that having five separate units, the table top plus four legs, can create some problems relating to transportation, loss of a part, specifically a leg, rusting of the connecting areas, and the actual mounting and demounting of the legs to and from the table top.

A prior art patent, while not anticipatory of the present invention, discloses a representative example of previous or known efforts to solve some of the structural problems relating to portable seats and tables. U.S. Pat. No. 3,220,362 issued Nov. 30, 1965 to Downes discloses a collapsible seat or stand which provides two sets of connected paired panels hingedly connected at vertical ends. When in the assembled position, these paired panels are set vertically upright, with one pair disposed inwardly between the other pair in diverging relationship, together with a pair of top panels hingedly connected to one of the pair of panels, and which together form a horizontal support. To obtain the collapsible position, the user presses together the two outer diverging panels, which will then swing to a collapsed position along with the inner pair of panels, and the top panels will separate and swing upwardly into a collapsed position.

The Downes invention has several obvious problems. One problem is the rather unsteady triangular support position. Another, is that the top of the structure is triangular, which limits the practicality of the structure as either a chair or a table. Also, the easy lateral collapsibility of the stand makes it of questionable value as a reliable means of holding objects or a person.

The present invention contemplates the elimination of most of these limitations and the disadvantages of conventional solutions. The invention is aware of the needs of the art, by providing a novel folding seat assembly that provides a seat of solid material, for the user with support members that hold the seat in a stable position, and that folds into a compact unit that can easily be placed in known folding table assemblies. In addition, the assembly can be used as a table with the members capable of being quickly and directly assembled, directly and providing a firm support for the table top.

Accordingly, it is an object of the present invention to provide a folding seat assembly that provides a seat of solid material.

It is a further object of my invention to provide a folding seat assembly that provides support structures that gives stability to the assembly.

It is a further object of this invention to provide a folding seat assembly with a seat of solid material that folds up into a compact volume capable of being inserted with other assemblies into a folding table assembly.

It is yet another object of my invention to provide a folding chair assembly having a solid seat with four support members that are capable of resting in pairs with one another.

It is yet another object of my invention to provide a folding chair assembly with a sold seat that can be assembled or disassembled as a unit without the necessity of adding or removing support structure.

It is a further object of this invention to provide a folding chair assembly with a seat of solid material with members that are rotatably connected and are capable of being rotatably unfolded or rotatably folded respective to assembled or disassembled positions.

It is yet another object of my invention to provide a folding table assembly that can be assembled or disassembled as a unit and that provides a stable support for the table top.

It is a further object of this invention to provide a folding seat and table assembly that is easy to assemble and disassemble, that folds to a compact volume, and that is inexpensive to construct.

The present invention fulfills the above objects and overcomes limitations and prior art solutions to problems by providing a novel assembly that can equally be applied to a seat or a table. In the preferred embodiment, which for purposes of exposition is a seat assembly, a substantially flat first member, or seat, has a top surface and an opposed undersurface and has at least one linear edge and an opposed end. Substantially flat second, third, fourth, and fifth members support the first member. The second member is rotatably connected to the first member at first mutually coextensive linear edges. The third member is rotatably connected to the second member at second mutually coextensive linear edges. The fourth member is likewise rotatably attached to the third member at third mutually coextensive linear edges. And the fifth member is rotatably connected to the fourth member at fourth mutually coextensive linear edges. All the linear edges are substantially parallel. The members are approximately of the same width, with the exception of the fifth member, which is preferably of less width than the first, second, third and fourth members.

The assembly is movable between an assembled, or unfolded position and a disassembled, or folded position. In the assembled position, the second member is upright with the second coextensive linear edges positioned closely spaced from a base surface such as a floor or the ground, and the first coextensive linear edges are positioned at an elevation, with the second member bearing against the base surface. The third member is disposed angularly relative to the first member with the third coextensive linear edges positioned substantially at the elevation mentioned. The fourth member extends between the third coextensive linear edges and the fourth coextensive linear edges. The fourth coextensive edge is position closely spaced from the base surface, with the fourth member being provided with means for bearing against the base surface. The fifth member extends from the fourth coextensive linear edges closely spaced from the base surface to the bottom portion of the upright second member. The second and fifth members are detachably mounted at the bottom portion. The first member is detachably mounted on the third and fourth members at the under surface of the first member at a transverse position between the linear edge and opposed end of the first member. The first member is also detachably connected to the fourth member by detachable connecting means.

In the disassambled, or folded position, the fourth and fifth members are detached from the second member and the first member is detached from the third and fourth members. The first and second members are rotated to positions of mutual association. The top surface of the first member is positioned adjacent to the second member. The second and third members are rotated to positions of mutual association. The fifth member is rotated between the third and fourth members. The third and fourth members are rotated to positions wherein the fifth member is in mutual association with the third and fourth members.

The assembly is preferably cast unitary of a flexible material such as a polymer plastic and the rotatable connections are made of the flexible material.

The second and third members are nested and the third and fourth members are nested in the disassembled position.

My invention will be more clearly understood from the following description of the invention, together with the accompanying drawings, wherein similar reference characters denote similar elements throughout the several views, and in which.

The invention will be described in detail with reference to the above-listed drawings.

Figure 3:
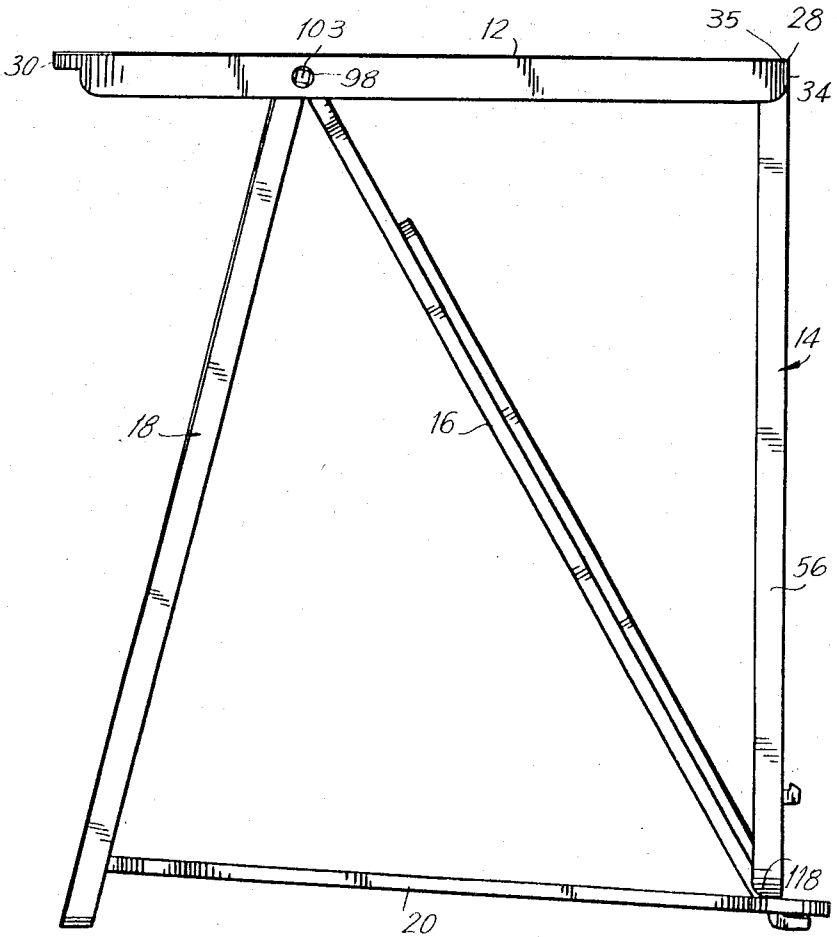
FIG. 3 is a side elevational view of the present invention shown in unfolded condition. This view represents a mirror image of the side elevational view of its opposite side.
Figure 6:
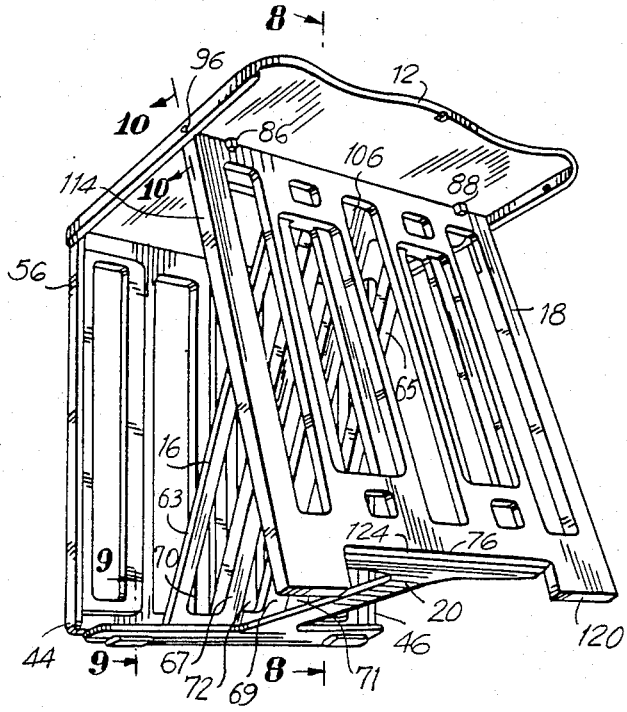
FIG. 6 is a perspective-type view of the invention shown in FIG. 3.

FIG. 6 is a perspective view of an overall assembly 10 according to the present invention as seen from the underside. Assembly 10 is seen in FIG. 6 in its unfolded, or assembled, mode and it includes first member 12, which, as assembled, is substantially horizontal; second member 14, which is substantially vertical as assembled; third member 16, which lies at an angle between first member 12 and second member 14; fourth member 18, which, extends at a slight angle from the vertical; and fifth member 20, which is substantially horizontal. All the members are rotatably joined at at least one and sometimes two areas as will be described. The members are preferably made of a flexible material, such as a polymer plastic. The bottoms of second and fourth members 14 and 18 are set upon a base surface, such as a floor or the ground, and which is not illustrated. FIG. 3 shows a side elevation of assembly 10 in its assembled mode.

Figure 1:
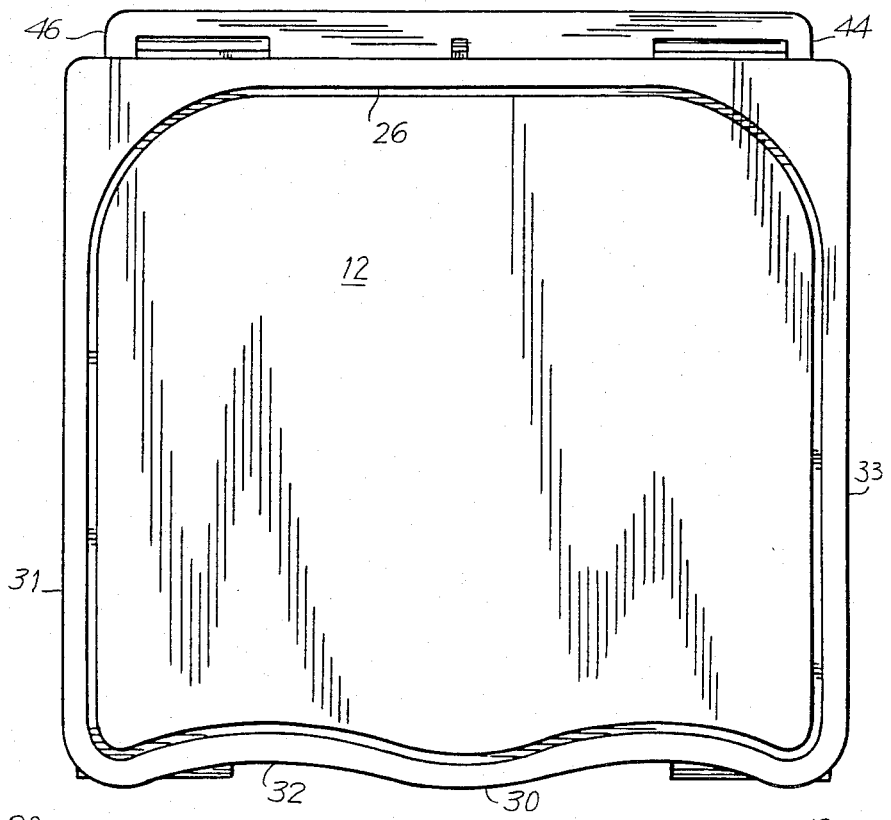
FIG. 1 is a top plan view of the invention in its unfolded condition.

First member 12, which is also seen from the top in FIG. 1, is the seat. Seat member 12 is constructed of any rigid material such as wood or plastic. Member 12 has a top planer surface 22 and an opposed undersurface 24 and is, as shown, flat and substantially rectangular. An optional contouring groove 26 is shown following the edge portions of the top surface 22. Top surface 22 within groove 26 can be provided with any decorative surface such as grained leather, inlaid decorative wood, and the like. Member 12 has at least one linear edge 28 and opposed end 30, which in the preferred version is provided with two inward undulations 32 for receiving the backs of the legs of a user. Edge 28 and end 30 are intersected by approximately parallel seat sides 31 and 33, having downwardly extending side extensions 37 and 39.

Figure 4:
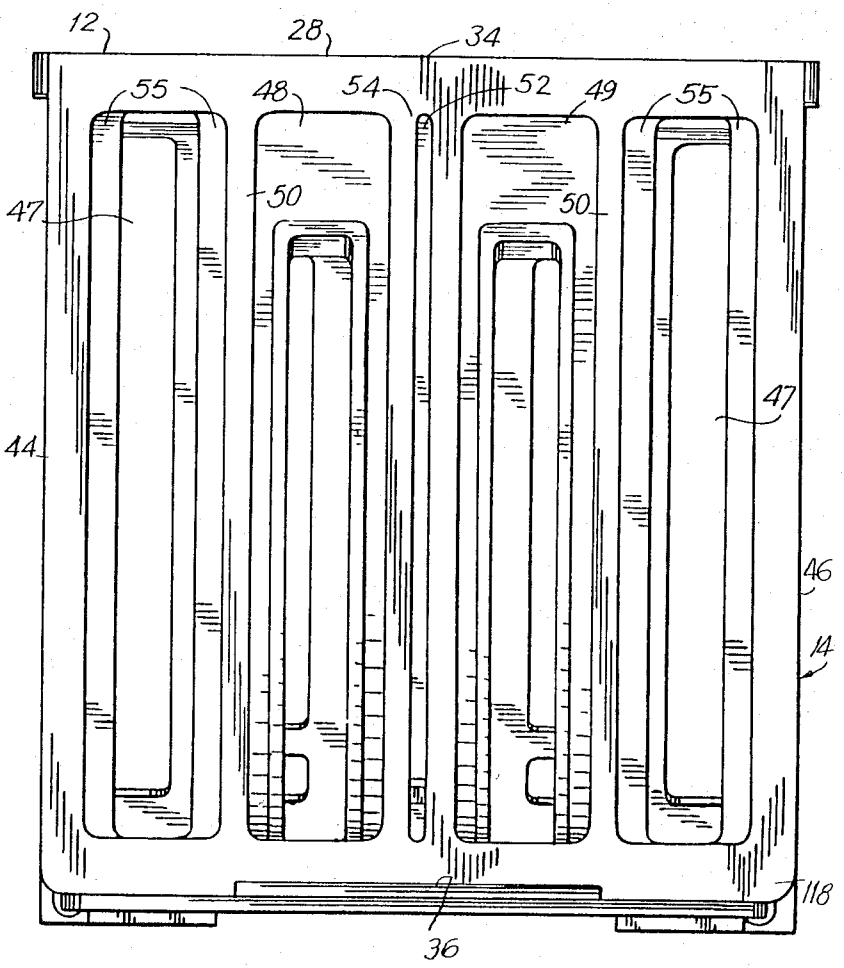
FIG. 4 is a back elevational view of the invention shown in FIG. 3.

Second member 14, which is also seen in full end view in FIG. 4, includes upper linear edge 34 and opposed lower linear edge 36. Upper edge 34 is coextensive with linear edge 28 of the first seat member 12. First and second members 12 and 14 are rotatably connected at linear edge portions 28 and 34 designated here as first coextensive linear edge portions connection 35. First member 12 is rotated from opposed end 30 around first joined coextensive edge portions connection 35. The flexible material of which all the members are molded allow the rotation from the assembled position to the disassembled, or folded, mode and back from the disassembled mode to the assembled mode. Preferably all five members are cast from one mold and are therefore basically unitary. This, however, is not a requirement of the invention, and all the connections described as flexibly rotatable can be of another design within the spirit of the invention. For example, each rotatable connection could be a hinged connection of one type or other known in the art.

Second member 14 partially supports seat member 12. Member 14 is substantially flat and rectangular in configuration with opposed lateral sides 44 and 46 that are upright in the assembled position slightly inwards of side 31 and 33 of seat 12. A pair of parallel longitudinal inner through nesting aperatures 48 and 49 are formed by member 14 on either side of center vertical (in assembled position) or longitudinal rib 54. Member 14 has a first thickness, generally designated as thickness 51 in sideview in FIGS. 8 and 11. Aperatures 48 and 49 face inwardly and are adapted to receive third member 16 in nesting position as will be discussed below. A pair of vertical (in assembled position), or longitudinal, outer side aperatures, generally designated 47, are formed by member 14 on either side of nesting aperatures 48 and 49. Through aperatures 47 are both for an aesthetic purpose and for reducing the weight of the assembly.

A decorative outwardly facing scooped trim 55 is formed around outer aperatures 47 and an outwardly facing scooped vertical groove 52 formed over rib 54 preferably decorate member 14. A pair of vertical posts generally designated posts 50 remain to separate side aperatures 47 from nesting aperatures 48 and 49. As seen in side view in FIGS. 3 and 6, vertical, inwardly extending end strips 56 are connected to lateral sides 44 and 46.

Figure 11:
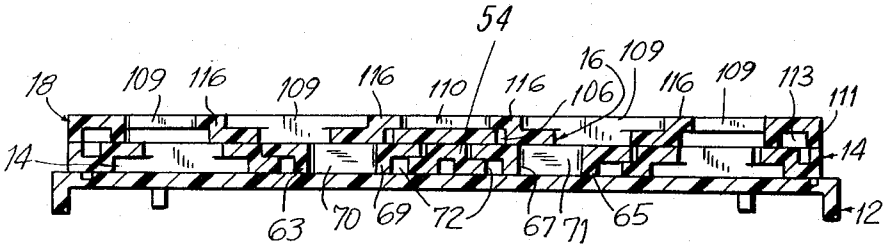
FIG. 11 is a sectional view of the invention in its folded condition taken through lines 11—11 in FIG. 7.
Figure 8:
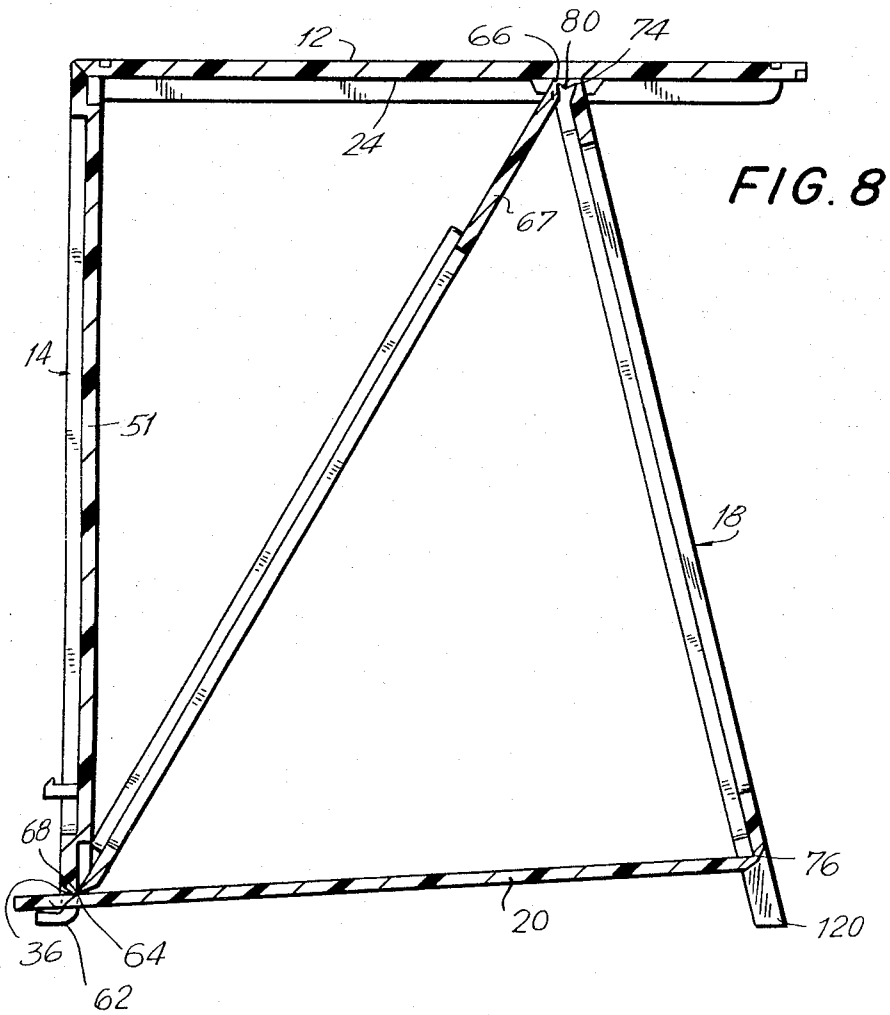
FIG. 8 is a side sectional view of the invention taken through line 8—8 in FIG. 6.

Third member 16 is angled relative to the vertical in the assembled position of assembly 10 between the bottom of second member 14 and undersurface 24 of first member 12. Third member 16 partially supports member 12 in the assembled, or unfolded position. The angle at which third member 16 is positioned is dependent upon the size of first member 12, the height of the first member, whether first member 12 is being designed as a seat or a table and other factors, and can vary within the spirit of the invention. Third member 16 is illustrated in FIGS. 3, 6 and 8 in the assembled mode and includes a lower linear edge 64 and a parallel upper linear edge 66. Third member 16 and second member 14 are flexibly and rotatably connected at second coextensive linear edge portion connection 68, which is located at the coextensive juncture of lower linear edge 36 of the second member and lower linear edge 64 of the third member, the term lower indicating relative position in the assembled mode. As is assembly 10 as a whole, both second and third members are preferably made of a flexible material such as a polymer plastic. As shown in FIG. 8, flexible connection 68 allows the second and third members to be flexibly rotated towards one another from the assembled position illustrated to the folded position to be described, with the inner surfaces of connection 68 being planer and the outer surface contoured in a curve so as to allow maximum inward rotatability with minimal stress on the flexible material. Slight variation in joint design between first and second rotatable connections 35 and 68 exist because of the differing tasks each joint must accomplish in reaching their assembled and disassembled positions. As can be seen in FIG. 6, third member 16 is preferably considerably narrower in width that second member 14, with two outer longitudinal side bars 63 and 65 and two inner longitudinal bars 67 and 69 forming a pair of outer longitudinal through apertures 70 and 71 and a central longitudinal through apertures 72. Side bars 63 and 65 are inwards of the upright sides 44 and 46 of second member 14. The side bars 63 and 65 are capable of being contained within nesting longitudinal through aperatures 48 and 49 of second member 14 with central through aperature 72 of third member 16 being capable of receiving central rib 54 of second member 14. Both second and third members 14 and 16 are approximately the same thickness, as seen in FIG. 11, and the two members are capable of evenly nesting without extending portions. The longitudinal side through aperatures 70 and 71 formed on either side of central through aperature 72 have the dual function of decoration and of removing unneeded material and thus reducing the weight of assembly 10.

Figure 2:
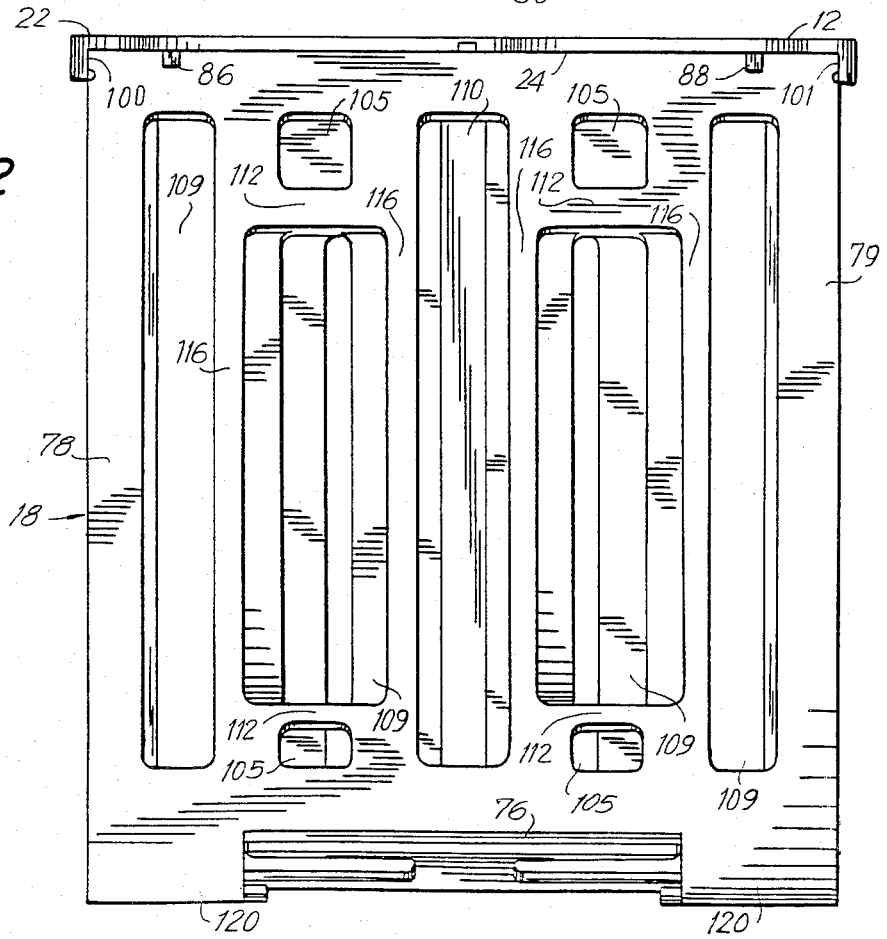
FIG. 2 is a front plan view of the present invention shown in FIG. 1.
Figure 10:
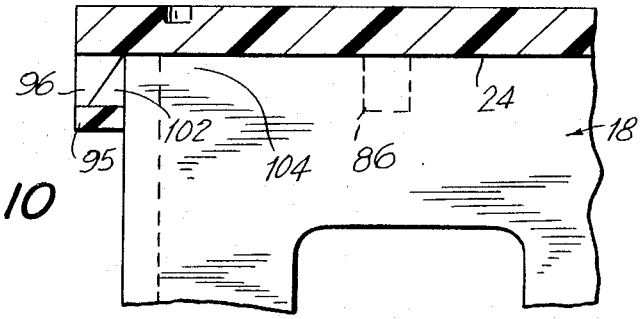
FIG. 10 is a detailed view of the seat top detachable connection taken through line 10—10 in FIG. 6.
Figure 12:
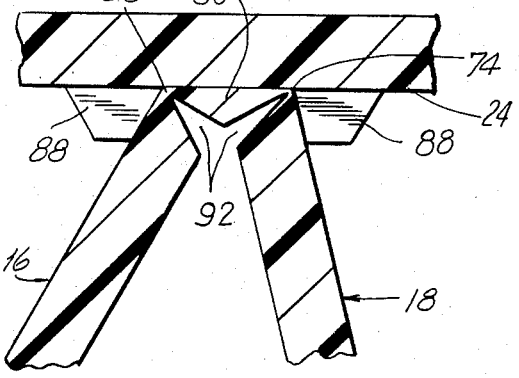
FIG. 12 is a detailed side view of the rotatable connection between third and fourth members as shown in FIG. 8 with the connection being in the unfolded assembly position.
Figure 13:
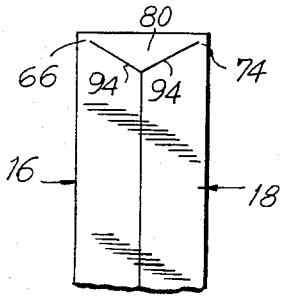
FIG. 13 is a detailed side view of the rotable connection shown in FIG. 12 with the assembly in a folded condition.

Fourth member 18, seen in FIGS. 2, 3, 6 and 8 in the assembled position, contributes to the support of seat member 12. In this mode member 18 is slightly angled from the vertical and is in bearing contact with undersurface 24 of first seat member 12. Member 18 is substantially flat and rectangular with opposed substantially parallel upper and lower parallel linear edges 74 and 76 respectively and opposed upright, or lateral, sides 78 and 79. Third and fourth members 16 and 18 are connected at upper linear edge 66 of member 16 and upper linear edge 74 of fourth member 18 at third coextensive linear edge portions connection 80. Connection 80 preferably is a flexibly rotatable connection as are first and second connections 35 and 68. Connection 80 as seen in FIG. 8 is positioned between seat sides 31 and 33 along the underside of seat member 12 at connection 80 distantly spaced from first connection 35 and closely spaced from seat end 30, the exact distances being capable of varying since the factors determining the relative distances vary. These include such factors as whether the seat is in fact a table top, the height at which the seat is positioned, and the angle at which third member 16 is angled. Both third and fourth members 16 and 18 are in bearing contact with first seat member 12 at connection 80, which detachably connects third and fourth members 16 and 18 to first member 12. Details of third flexible connection 82, seen in side view in FIG. 8, are shown in FIG. 12 with assembly 10 in assembled mode and in FIG. 13 in the disassembled mode with the first seat member having been rotated away from connection 80. As shown in FIG. 12, third and fourth members 16 and 18 are angled towards one another with connection 80 in direct contact with undersurface 24 of the seat member. Two pairs of blocking members 86 (not shown in this view) and 88 are mounted on undersurface 24 and are adapted to hold third flexible connection 80 in position at undersurface 24. A pair of angled longitudinal slots 92 formed on the inner portions of third connector 80 are open in the assembled position as seen in FIG. 12 and in the disassembled position close up to slits 94 as shown in FIG. 13. A frontal view of fourth member 18 is seen in FIG. 2, which shows one side of each pair of blocking members 86 and 88; and in the detailed section of FIG. 10, which shows one block of block pair 86 in section. FIG. 10 further shows detachable connection 95 including one of a pair of opposed locking holes 96 and 98 formed in lower extensions 37, 39 of seat sides 31; recesses 96 and 98 (FIG. 3) are capable of receiving a pair of opposed lateral snap-in pin members 102, 103 formed on opposing sides of fourth member 18 extended outwardly from top side portion 104 of member 18. Pins 102 are capable of being maneuvered in and out of holes 96, 98 during assembly and disassembly movements of the seat member and the fourth member because of the overall flexibility of assembly 10. As shown most clearly in FIGS. 2 and 10, fourth member 18 is approximately the same width as seat member 12 with outer edges 100, 101 of member 18 abutting the inner surfaces of lower extensions 37, 39 of the seat member. Third coextensive connection 80 runs the length of the top side 104 of the fourth member, FIG. 5). Third and fourth members 16 and 18 are foldable towards one another so that they are in close, but not direct, association with one another when the seat is folded. Fourth member 18 on its inward side forms a central longitudinal recess 106 and an opposed transverse recess 107 at its upper end and opposed transverse recess 108 at its lower end, transverse recesses 107 and 108 being connected to longitudinal recess 106, thus forming one continuous inner recess. Recesses 106, 107, and 108 face inwardly facing fifth member 20 when in the folded, or disassembled position of FIG. 11, as will be discussed. Fourth member 18 has a thickness, as shown in FIG. 11 and recesses 106, 107 and 109 have a depth, generally designated as 113 in Fig. 11. Fourth member 18 forms five substantially parallel decorative and material removing through aperatures generally designated as four aperatures 109, with center or through aperatures designated as aperature 110, four vertical ribs 116 separating the five through aperatures. Smaller, two over, and two under, through aperatures 111 formed over and under the aperatures 109 are disposed on each side of center aperatures 110; under and over through aperatures 108 are separated from those of aperatures 108 disposed next to center aperatures 110 by four cross-bars 112. All the through aperatures are for the purpose of aesthetics and for reducing weight. Fourth member 18 has bottom portion 118 with two feet 120 extending down from bottom portion 18 at outer edges 78, 79. Feet 120 extend from bottom portion 118 and rest upon a floor or ground base surface (not shown). Lower linear edge 76 of the fourth member 18 is positioned slightly above the level of feet 120 approximately between the feet.

Figure 5:
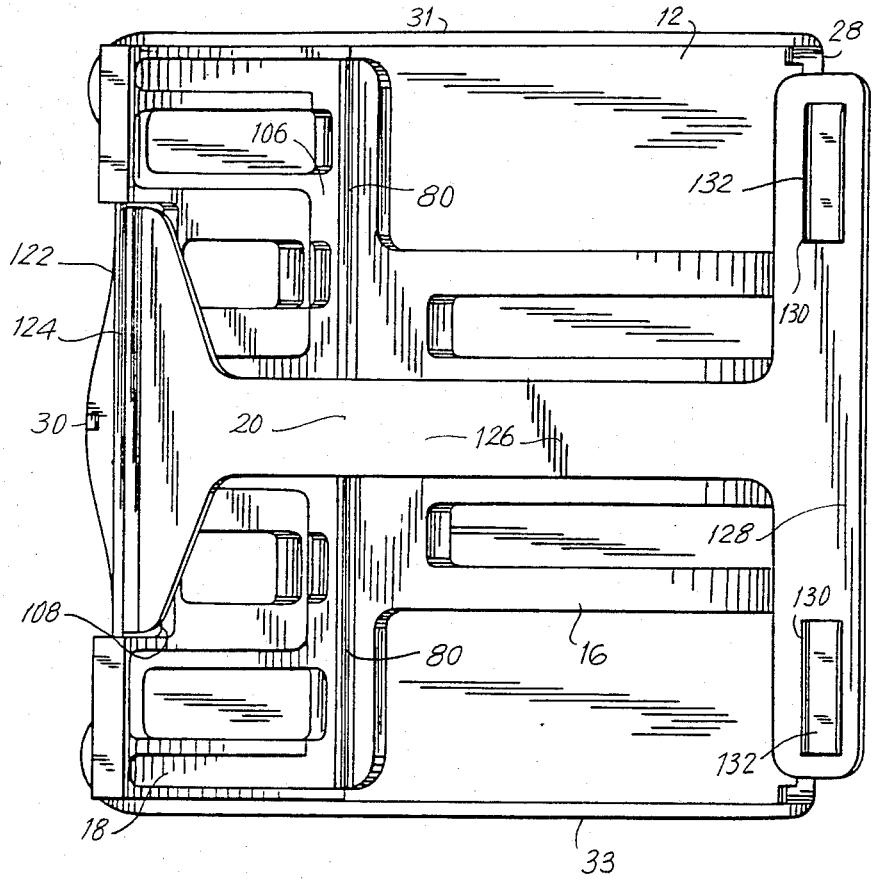
FIG. 5 is a bottom elevational view of the invention shown in FIG. 3.

Fifth member 20 seen in bottom view in FIG. 5 extends approximately horozontally between fourth member 18 and second member 14 and braces the two members and locks assembly 10 into the assembled position. Member 20 has a linear end 122 that is rotatably and flexibly connected to lower linear edge 76 to form fourth coextensive linear edge portions connection 124. Connection 124, best seen in side sectional view in FIG. 8, is cut flat on its inner side for rotation against fourth member 18 and rounded on its outer side to reduce stress in the flexible material as the fourth and fifth members 18 and 20 are rotated to and from one another between the assembled and folded positions. As stated, assembly 10 is preferably made of a flexible material such as a polymer plastic, so that each rotatable connection can be molded into the assembly as a unit, but other rotatable connection designs are of course possible. Linear end 122 connects to first cross-bar 125, which narrows to flat bottom support 126 that extends along the bottom center of assembly 10 to a detachable connecting end, which is in the configuration of a flat second cross-bar 128 extending from each side of center support bar 126. A pair of downward facing slots 130 formed on each side of cross-bar 128 are capable of receiving feet 62 of second member 14 at detachable connection 132 when assembly 10 is in the assembled position as shown in FIGS. 3, 5, 6 and 8. Feet 62 are in contact with the base surface floor or ground while cross-bar 128 is spaced slightly from the base surface at detachable connections 132. When being disassembled, feet 62 are maneuvered out of slots 130 and second and fifth members 14 and 20 are disconnected in preparation for folding of the assembly. When the assembly is being assembled, second and fifth members 14 and 20 are connected by maneuvering feet 62 through slots 130. Fifth member 20 and fourth member 18 are capable of being rotated towards one another around fourth connection 124 so that the members are in close association. Flat second cross-bar 128 nests into fourth member 18 at inner transverse recess 106 when the assembly is in the mounted position. Likewise, first crossbar 124 nests into transverse recess 108 of fourth member 18, and center support bar 126 nests into central longitudinal recess 106 of fourth member 18. Fifth member 20 has a thickness that is less than the thickness of fourth member 18. The thickness of fifth member 26 is approximately the depth of central recess 106 and opposed transverse recesses 107 and 108 of fourth member 18. Thus, fifth member 20 is capable of nesting within fourth member 18 in the nesting position.

Assembly 20 is, as mentioned, movable as a whole between assembled and disassembled positions. The disassembled position is where the assembly is folded up in preparation for placement in a carrying case (not shown). In the assembled position, second member 12 is substantially upright with second joined coextensive linear edges connection 68 positioned on a base supporting surface (not shown) approximately horizontal. First joined coextensive linear edges connection 35 is positioned at approximately the usual elevation for a chair. If first member 12 is a table top, the elevation of first connection 35 will be somewhat higher. Second member 14 includes means for bearing against the bare surface. Third member 16 is disposed angularly relative to first member 12. Third joined edges connection 80 is positioned substantially at the same elevation as second joined edges connection 68. Fourth member 18 extends between the third edges connection 80 and fourth edges connection 124. Fourth connection 124 is positioned closely spaced from the base surface. Fourth member 18 includes means for bearing against the base surface. Fifth member 20 extends from fourth joined coextensive linear edges connection 124 closely spaced from the bare surface to the bottom portion 118 of second member 14. Second and fifth members 14 and 20 are detachably mounted at bottom portion 118 of member 14. First member 12 is detachably mounted on second and third members 14 and 16 at undersurface 24 of first member 12 at connections 86, 88 and 96, 98 positioned between linear edge 28 of the first member and opposed end 30.

Figure 14:
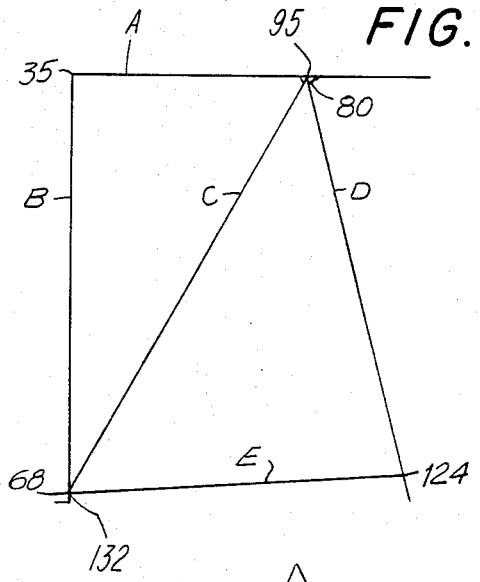
FIG. 14 is a schematic side view showing the invention in an unfolded condition.
Figure 15:
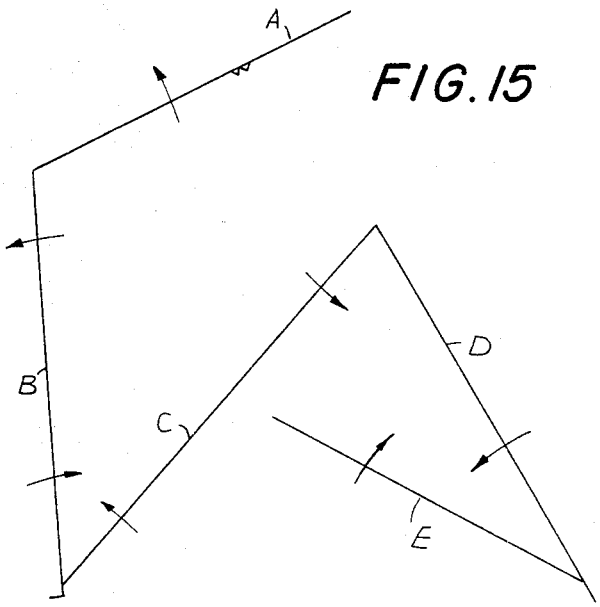
FIG. 15 is a schematic side view showing the invention partially unfolded.
Figure 16:
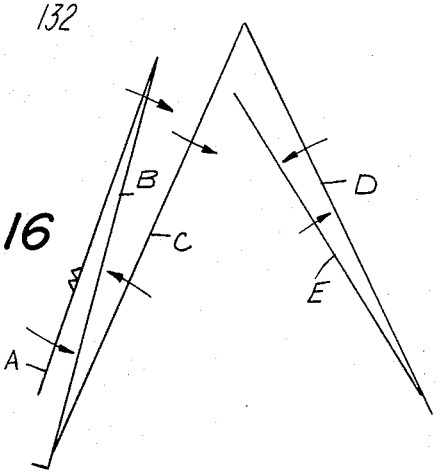
FIG. 16 is a schematic side view showing the invention close to a folded condition.

FIG. 14 illustrates the five members as assembled with the following designations: first member 12-A; second member 14-B; third member 16-C; fourth member 18-D; and fifth member 20-E. First, second, third and fourth rotatable connections 35, 68, 80 and 124 are indicated. Likewise, detachable connections 95 connecting E with B and detachable connections 132 connecting A with D are indicated. The first steps of demounting the assembly and moving it towards the folded up position are to detach E from B and A from D via detachable connections 95 and 132 as shown in FIG. 15. Then A and B are rotated, towards one another about connection 35 so that surface 22 of the first member 12 moves toward contact with second member 14; members B and C are rotated towards one another about connection 68 so that C comes into association with B opposite to A; members C and D are rotated towards one another about connection 80; members D and E are rotated towards one another about connection 124 so that E comes into association with D on one side and into association with C on the other side. FIG. 16 continues the movements described for FIGS. 14 and 15.

Figure 7:
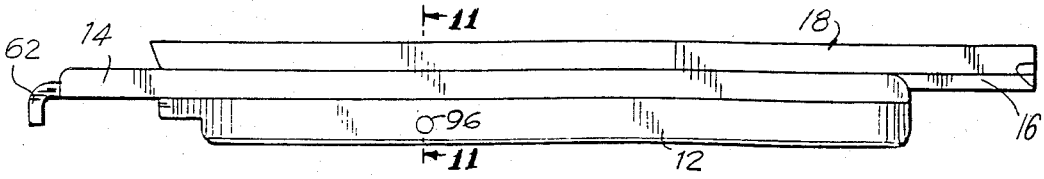
FIG. 7 is a side view of the invention shown in FIG. 3 in its folded condition. This view is a mirror image of the opposite side elevation.
Figure 9:
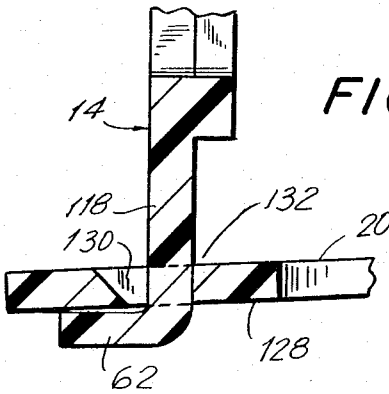
FIG. 9 is a detailed sectional view of the detachable connection taken through line 9—9 in FIG. 6.
Figure 17:
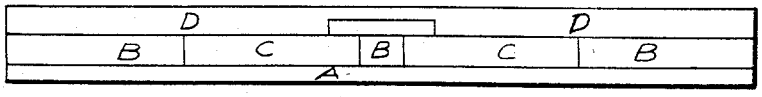
FIG. 17 is a side-view of the invention analagous to FIG. 11 showing the configuration of the nesting scheme.

FIG. 7 is a side view of assembly 10 fully folded with the members nesting as to be described. FIG. 11 is a cross-section of FIG. 7 and shows some of the details of the nesting. FIG. 17 is a schematic illustration of the nesting shown in FIG. 11 using the same alphabetical designations for the five members as used for FIGS. 14, 15 and 16. FIG. 7 illustrates assembly 20 with first seat member 12 on the bottom, a position which has no operative significance, with second member 14 disposed above member 12, and fourth member 18 disposed over second member 14. A portion of third member 16 extends from its nesting position within second member 14 adjacent to fourth member 18. Fifth member 20 is not seen in this view since it is nested within fourth member 18. FIG. 11 indicates the nesting relationships between the members. Second and third members 14 and 16 are in nesting association with one another as are fourth and fifth members 18 and 20. In particular, third member 16 nests aperatures 70 and 71 of second member 14, vertical interior rib 54 of second member 14 nesting in mating aperatures 72 of third member 16; and support bar 116 of fifth member 20 nests in recesses 106, 107 and 109 of fourth member 18. The schematic cross-section of FIG. 17 illustrates this relationship more clearly. In the folded position A and B; B and C; D and E; and C and E are in folded association; with B and C; and D and E in addition being in nesting relationship.

Assembly 20 is unfolded from its disassembled position as shown in FIG. 7, 11 and 17 by reversing the process shown in FIGS. 14, 15 and 16, that is by rotating the members from FIG. 16 to FIG. 15 to the assembled position of FIG. 14. In addition, second member 14 is connected to fifth member 20 at detachable connection 132; and first member 12 is connected to fourth member 18 at detachable connection 95. In addition third linear connection 80 is positioned between blocking elements 86 and 88 at bearing connection 92. Assembly 20 is then fully assembled and ready for use.

The embodiment of the invention particularly disclosed and described hereinabove is presented merely as an example of the invention. Other embodiments, forms, and modifications of the invention coming within the proper scope and spirit of the appended claims will, of course, readily suggest themselves to those skilled in the art. For example, the rotatably flexible connections described and illustrated here could be substituted for by other types of rotatable connections within the scope of the invention. Also, references to first member 12 can be applied to the first member being used as a seat or a table within the scope of the invention. Thus, my reference to the first member as seat can likewise be equally applied to the term table top.

What is claimed is:

1. A combination folding seat and table assembly, in combination, comprising:

a substantially flat first member including a top surface and an opposed undersurface and having at least one linear edge and an opposed end;

substantially flat second, third, fourth, and fifth supporting members;

said second member being rotatably connected to said first member at first coextensive linear edges;

said third member being rotatably connected to said second member at second coextensive linear edges;

said fourth member being rotatably connected to said third member at third coextensive linear edges; and said fifth member being rotatably connected to said fourth member at fourth coextensive linear edges;

said linear edges being substantially parallel;

said assembly being movable between assembled and disassembled positions;

wherein in said assembled position;

said second member is upright with said second coextensive linear edges positioned closely spaced from a base surface and said first coextensive linear edges being positioned at an elevation, said second member having means for bearing against said base surface;

said third member is disposed angularly relative to said first member with said third coextensive linear edges positioned substantially at said elevation;

said fourth member extends between said third coextensive linear edges and said fourth coextensive linear edges, said fourth coextensive edges being positioned closely spaced from said base surface, said fourth member having means for bearing against said base surface;

said fifth member extends from said fourth coextensive linear edges closely spaced from said base surface to the bottom portion of said second member, said second and fifth members being detachably mounted at said bottom portion; and said first member is detachably mounted on said third and fourth members at said third coextensive linear edges at said undersurface of said first member at a transverse position between said at least one linear edge and said opposed end, said first member being also detachably connected to said fourth member by detachable connecting means, and wherein in said disassembled position said fourth and fifth members are detached from said second member, and said first member is detached from said third and fourth members;

said first and second members are in mutual association, said second and third members are in mutual association, and said fifth member is in mutual association with said third and fourth members.

2. A combination folding seat and table assembly according to claim 1, further including first means for nesting said second and third members; and second means for nesting second, third and fourth members when said assembly is in said disassembled positions.

3. A combination folding seat and table assembly according to claim 2, wherein said first means for nesting includes said second member having a longitudinal center rib and forming a pair of longitudinal through aperatures on either side of said rib, said second member having a first thickness;

said third member forming a central longitudinal through aperature, said third member including opposed longitudinal sides lateral to said central aperature, said sides being contained within said pair of first aperatures and said central aperatures receiving said rib, said third member having a second thickness approximately equal to said first thickness.

4. A combination folding seat and table assembly according to claim 3, wherein said second means for nesting includes said fifth member having a central longitudinal element connected to a transverse element at one end and an opposed transverse element at the opposite end of said central element, said fifth member having a third thickness; and said fourth member forming a central longitudinal recess and a connecting transverse recess at one end and a connecting opposed transverse recess at the opposite end of said central recess, said recesses facing said fifth member and having a depth, said fourth member having a fourth thickness greater than said third thickness, said first thickness being substantially equal to said depth, said central, transverse, and opposed transverse recesses receiving said central, transverse, and opposed transverse elements.

5. A combination folding seat and table assembly according to claim 4, wherein said assembly is unitary and made of a flexible material.

6. A combination folding seat and table assembly according to claim 5, wherein said members are rotatably connected at said coextensive linear edges by flexible connections, said connections being unitary with said assembly.

7. A combination folding seat and table assembly according to claim 6, wherein said first member is detachably mounted on said third and fourth members in said assembled position by means of said undersurface of said first member being provided with a plurality of blocking elements disposed to form a transverse downward facing slot capable of receiving said third coextensive linear edge in bearing contact with said undersurface, said first member having opposed side extensions extending past said underside, said side extensions forming a pair of opposed holes, said fourth member having a pair of opposed lateral sides and a pair of opposed transversely extending pins connected to said lateral sides, said pins being removably positioned through said holes.

8. A combination folding seat and table assembly according to claim 7, wherein said second and fifth members are detachably mounted by means of said fifth member forming a pair of through passages in said transverse element and a pair of laterally outwardly extending feet connected to the bottom portion of said second member removably mounted through said pair of passages, said feet being in contact with said bare surface.

9. A combination folding seat and table assembly in accordance with claim 1, wherein said first member is a seat.

10. A combination folding seat and table assembly in accordance with claim 1, wherein said first member is a table top.

* * * * *